US009010163B2

(12) United States Patent
Romero

(10) Patent No.: US 9,010,163 B2
(45) Date of Patent: Apr. 21, 2015

(54) REMOVABLE KEY CASSETTE ASSEMBLY

(71) Applicant: Kwikset Corporation, Lake Forest, CA (US)

(72) Inventor: Oscar Romero, Lake Forest, CA (US)

(73) Assignee: Kwikset Corporation, Lake Forest, CA (US)

( * ) Notice: Subject to any disclaimer, the term of this patent is extended or adjusted under 35 U.S.C. 154(b) by 0 days.

(21) Appl. No.: 14/210,642

(22) Filed: Mar. 14, 2014

(65) Prior Publication Data

US 2014/0260461 A1 Sep. 18, 2014

Related U.S. Application Data

(60) Provisional application No. 61/790,503, filed on Mar. 15, 2013.

(51) Int. Cl.
*E05B 27/00* (2006.01)
*E05B 9/08* (2006.01)

(52) U.S. Cl.
CPC ..... *E05B 27/0003* (2013.01); *E05B 27/005* (2013.01); *E05B 9/086* (2013.01)

(58) Field of Classification Search
USPC ..... 70/490, 492, 367, 368, 371, 375, 378
See application file for complete search history.

(56) References Cited

U.S. PATENT DOCUMENTS

| | | | | |
|---|---|---|---|---|
| 1,565,558 A | | 12/1925 | Fremon | |
| 1,761,092 A | | 6/1930 | Shinn | |
| 3,009,349 A | * | 11/1961 | Check | 70/369 |
| 3,416,336 A | | 12/1968 | Felson | |
| 3,512,382 A | | 5/1970 | Check et al. | |
| 3,633,393 A | | 1/1972 | Hisatsune | |
| 3,837,194 A | | 9/1974 | Fish | |
| 4,123,926 A | * | 11/1978 | Elder | 70/369 |
| 4,317,156 A | | 2/1982 | Stangl | |
| 4,386,510 A | * | 6/1983 | Best et al. | 70/369 |
| 4,484,462 A | * | 11/1984 | Berkowitz | 70/368 |
| 4,627,251 A | | 12/1986 | Bhate | |
| 4,836,002 A | * | 6/1989 | Monahan | 70/382 |
| 4,936,896 A | | 6/1990 | Takatsuka | |
| 4,953,373 A | * | 9/1990 | Toledano | 70/369 |

(Continued)

FOREIGN PATENT DOCUMENTS

| | | | |
|---|---|---|---|
| DE | 4101978 | C1 | 5/1992 |
| DE | 9300375 | U1 | 5/1993 |
| DE | 10122125 | C1 | 9/2002 |

OTHER PUBLICATIONS

Patent Cooperation Treaty; International Search Report; Jul. 25, 2014.

*Primary Examiner* — Suzanne Barrett
(74) *Attorney, Agent, or Firm* — Barnes & Thornburg LLP

(57) ABSTRACT

A lock assembly is provided that includes: a lock cylinder having a bore disposed therein and at least one pocket located adjacent the periphery of the bore; a plug including a cassette slot; a plunger that fits in the plug; a locking tab having a slot disposed therein; the slot of the locking tab receives a portion of the plunger; a cassette having a key slot configured to receive a key; the cassette includes a tool slot configured to receive a tool to selectively engage the plunger to selectively move at least a portion of the locking tab into and out of the pocket; when a portion of the locking tab is located in the pocket the locking tab does not block the cassette from being removed from the plug.

7 Claims, 11 Drawing Sheets

(56) References Cited

U.S. PATENT DOCUMENTS

| | | | | |
|---|---|---|---|---|
| 5,548,984 | A | 8/1996 | Miyatsu | |
| 5,979,200 | A * | 11/1999 | Cliff | 70/491 |
| 6,301,942 | B1 * | 10/2001 | Shvarts | 70/367 |
| 6,578,396 | B2 * | 6/2003 | Field et al. | 70/371 |
| 6,705,139 | B2 | 3/2004 | Tsai | |
| 6,981,396 | B1 * | 1/2006 | Kim | 70/495 |
| 7,290,418 | B2 * | 11/2007 | Herdman | 70/383 |
| 7,533,550 | B2 * | 5/2009 | Herdman | 70/340 |
| 7,845,202 | B2 | 12/2010 | Padilla et al. | |
| 7,958,759 | B2 * | 6/2011 | Herdman | 70/371 |
| 8,151,611 | B2 * | 4/2012 | Herdman | 70/371 |
| 8,336,349 | B2 * | 12/2012 | Thimmappa et al. | 70/371 |
| 8,707,746 | B1 * | 4/2014 | Liu | 70/493 |
| 8,794,042 | B2 * | 8/2014 | Herdman | 70/383 |
| 2006/0010945 | A1 * | 1/2006 | Herdman | 70/493 |
| 2009/0158794 | A1 | 6/2009 | Lo | |
| 2009/0241620 | A1 * | 10/2009 | Field et al. | 70/360 |
| 2010/0050715 | A1 | 3/2010 | Hu et al. | |

* cited by examiner

REMOVABLE KEY CASSETTE ASSEMBLY

RELATED APPLICATIONS

This present application is related to and claims priority to U.S. Provisional Patent Application Ser. No. 61/790,503, filed on Mar. 15, 2013, entitled "Removable Key Plug Assembly." To the extent not included below, the subject matter disclosed in that application is hereby expressly incorporated into the present application.

TECHNICAL FIELD

The present disclosure relates generally to lock cylinders and particularly to lock cylinders that may be rekeyed. More particularly, the present disclosure relates to a cassette that is removable from the lock cylinder to be rekeyed or repinned.

SUMMARY

The present disclosure relates to a key lock cylinder that includes a cassette configured to receive a key. The cassette fits into a key plug which then fits into the lock cylinder. The cassette is configured to be selectively removable from the plug and a portion of the lock mechanism may be reconfigured so the cassette receives a new key. After rekeying (or repinning) the cassette, it may be reinserted and secured in the plug. The rekeyed (or repinned) cassette will then be able to accept the new key which will be configured to unlock the cylinder and, thus, the latch.

Another illustrative embodiment of the present disclosure provides a lock assembly comprising: a lock cylinder having a bore disposed therein and at least one pocket located adjacent the periphery of the bore; the cylinder includes a chimney that houses top pins and corresponding springs; a plug including a cassette slot, top opening, and a plunger bore; the plug being held in the lock cylinder by a retaining clip; a plunger fits in the plunger bore of the plug; a locking tab having a slot disposed therein; the slot of the locking tab receives a portion of the plunger; a cassette having a key slot configured to receive a key, and openings configured to receive a plurality of pins that when the key is inserted into the key slot, the pins do not extend beyond a shear line located between the periphery of the lock cylinder bore and its chimney; the cassette includes a tool slot configured to receive a tool for engaging the plunger to selectively move at least a portion of the locking tab to the pocket; when at least the portion of the locking tab is located in the pocket the locking tab does not block the cassette from being removed from the bore in the lock cylinder; and wherein the cassette is available to be rekeyed.

The above and other illustrative embodiments may include a lock assembly that further comprises: a spring that biases the plunger; and when rotating the plug with respect to the lock cylinder the top pins are prevented from exiting the chimney when the cassette is removed from the plug.

Another illustrative embodiment of the present disclosure provides a lock assembly comprising: a lock cylinder having a bore disposed therein and at least one pocket located adjacent the periphery of the bore; a plug including a cassette slot; a plunger that fits in the plug; a locking tab having a slot disposed therein; the slot of the locking tab receives a portion of the plunger; a cassette having a key slot configured to receive a key; the cassette includes a tool slot configured to receive a tool to selectively engage the plunger to selectively move at least a portion of the locking tab into and out of the pocket; when a portion of the locking tab is located in the pocket the locking tab does not block the cassette from being removed from the plug.

The above and other illustrative embodiments may include a lock assembly that further comprises rotating the plug with respect to the lock cylinder preventing the top pins from exiting the lock cylinder when the cassette is removed from the plug.

Another illustrative embodiment of the present disclosure provides a method for rekeying a lock cylinder comprising the steps of: providing a lock cylinder that receives a plug, and wherein the plug receives a cassette; inserting a key into a key slot in the cassette; rotating the cassette and plug with respect to the lock cylinder; inserting a tool through a tool slot located in the cassette and engaging a plunger located in the plug for moving a locking tab; moving the locking tab to cease it from being a barrier that prevents the cassette from being removed from the plug; and removing the cassette from the plug.

Additional features and advantages of the removable key cassette assembly will become apparent to those skilled in the art upon consideration of the following detailed description of the illustrated embodiment exemplifying the best mode of carrying out the disclosure as presently perceived.

BRIEF DESCRIPTION OF THE DRAWINGS

The present disclosure will be described hereafter with reference to the attached drawings which are given as non-limiting examples only, in which.

Figure 1:
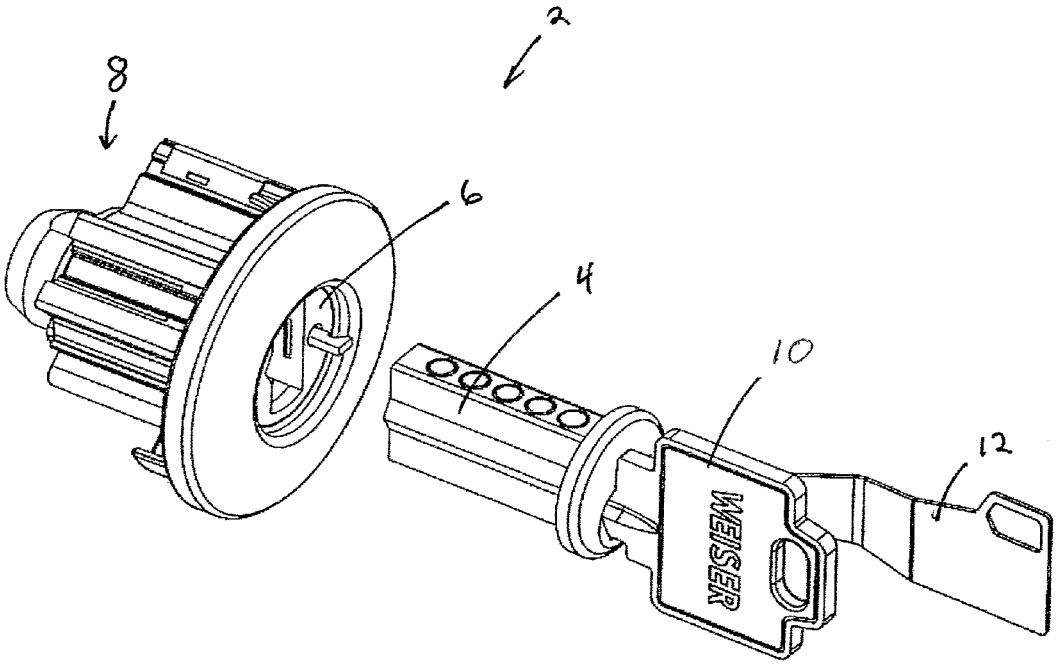
FIG. 1 is a partially exploded perspective view of a removable cassette and lock assembly.

Corresponding reference characters indicate corresponding parts throughout the several views. The exemplification set out herein illustrates embodiments of the removable key cassette assembly, and such exemplification is not to be construed as limiting the scope of the removable key cassette assembly in any manner

DETAILED DESCRIPTION

A perspective view of removable cassette, pin, and tumbler lock assembly 2 is shown in FIG. 1. This view demonstrates how cassette 4 is removable from plug 6 located in cylinder 8. Using the original key 10 inserted into cassette 4 and resetting tool 12, cassette 4 is removable from plug 6 allowing cassette 4 to be rekeyed to a new keying configuration. It is appreciated that in this embodiment only cassette 4 is removable, not the entire plug 6. It is further appreciated that the top pins remain trapped on the chimney as cassette 4 is removed.

Figure 2:
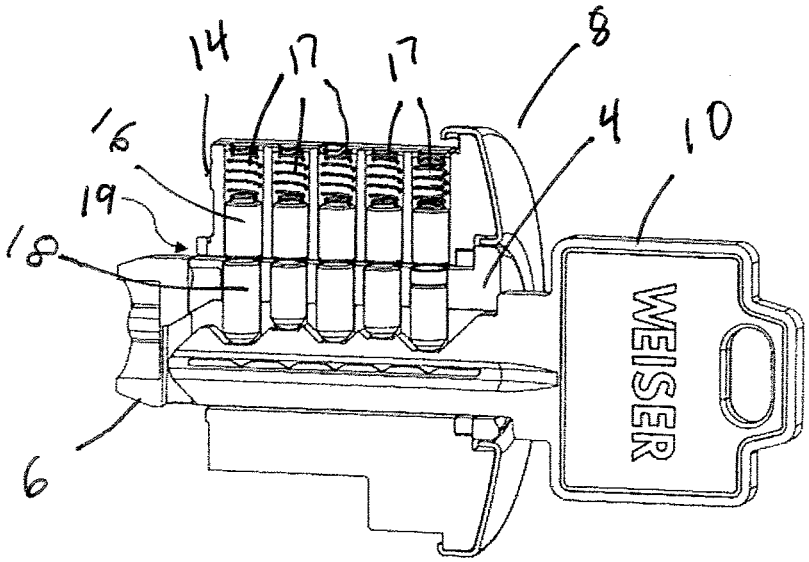
FIG. 2 is a side perspective cross-sectional view of the pin and tumbler cylinder lock assembly with the cassette of FIG. 1.

A side perspective cutaway view of lock assembly 2 is shown in FIG. 2. This view shows the components fitted in cylinder 8 with key 10 inserted and the pins located in an unlocked position. Chimney 14 houses top pins 16 and springs 17. It is appreciated that springs 17 bias top pins 16 toward lower pins 18. When key 10 is properly inserted, the top of lower pins 18 form a shear line 19 with upper pins 16 allowing key 10 to rotate cassette 4 and plug 6 to unlock the door latch. In this embodiment, only lower pins 18 will be removed with cassette 4. Top pins 16 remain in chimney 14 during the rekeying process. This means the rekeying process is that much simpler. Plug 6 will be rotated to keep top pins 16 in chimney 14. Lower pins 18 will likewise remain in cassette 4 and removed once cassette 4 is removed from plug 6.

Figure 3:
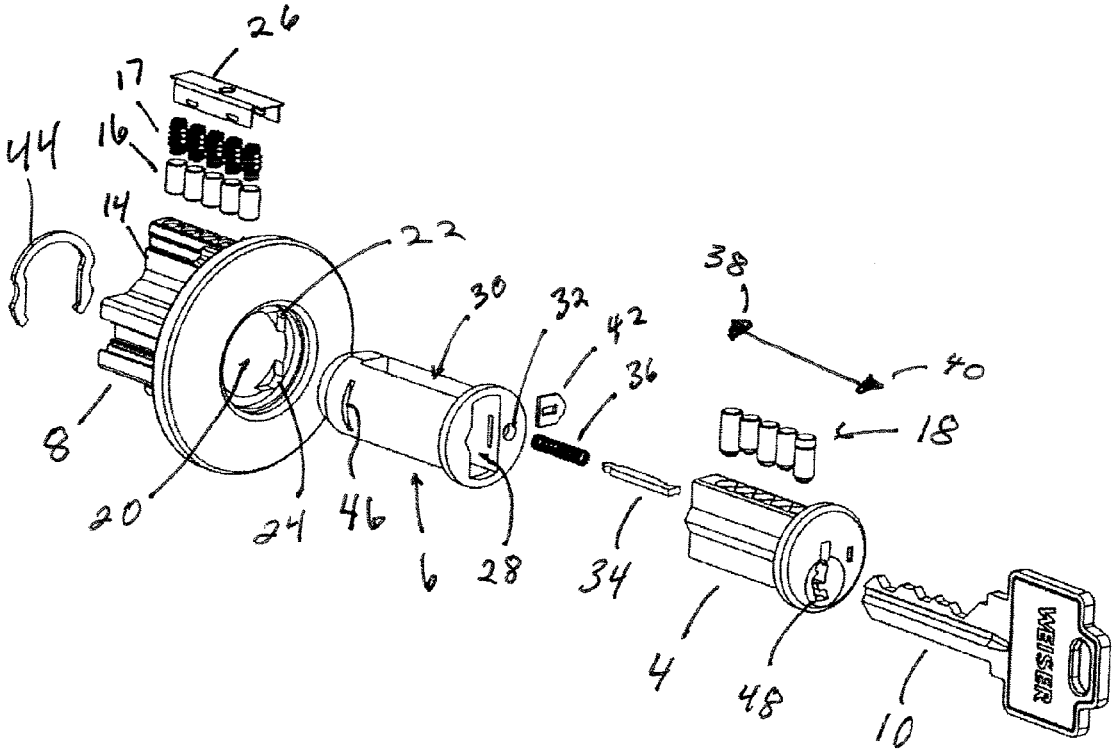
FIG. 3 is a perspective exploded view of the removable cassette, pin, and tumbler lock assembly.
Figure 4:
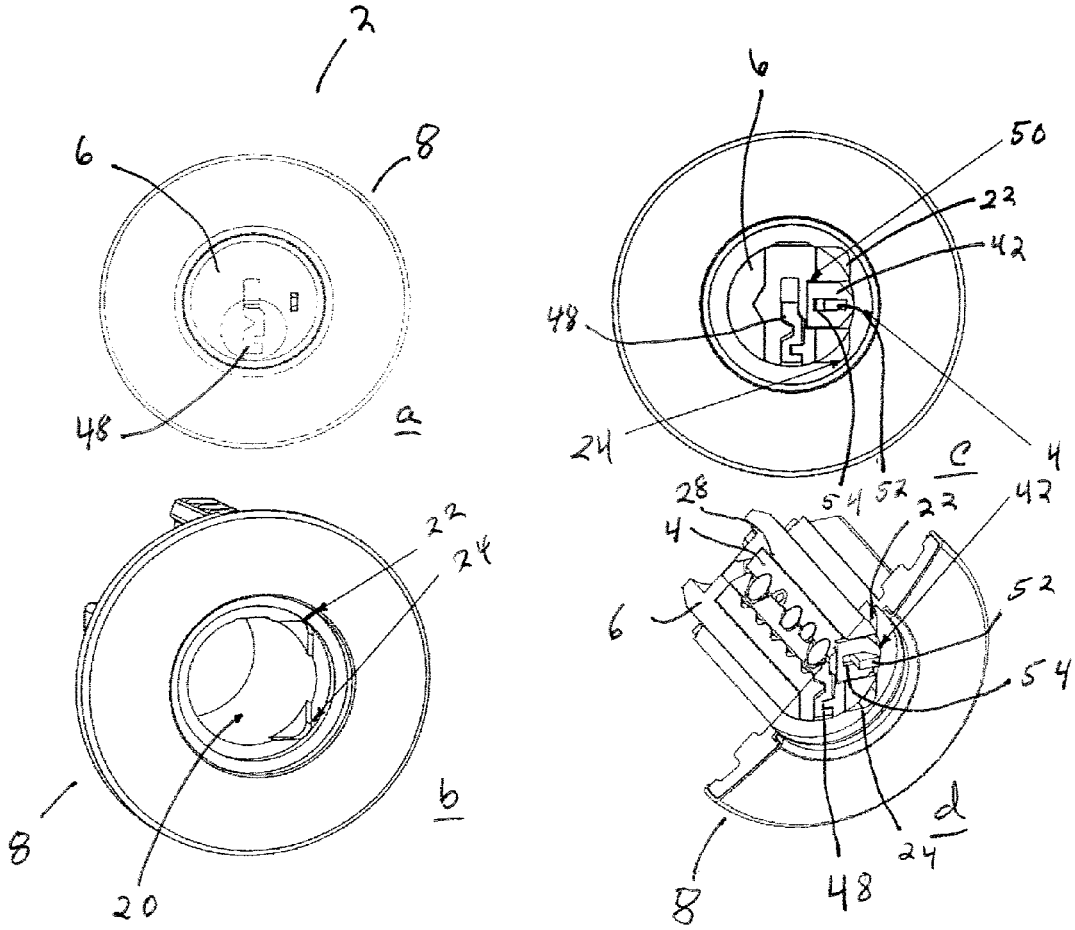
FIGS. 4*a-d* are front, perspective, and perspective cutaway views of the lock assembly.
Figure 5:
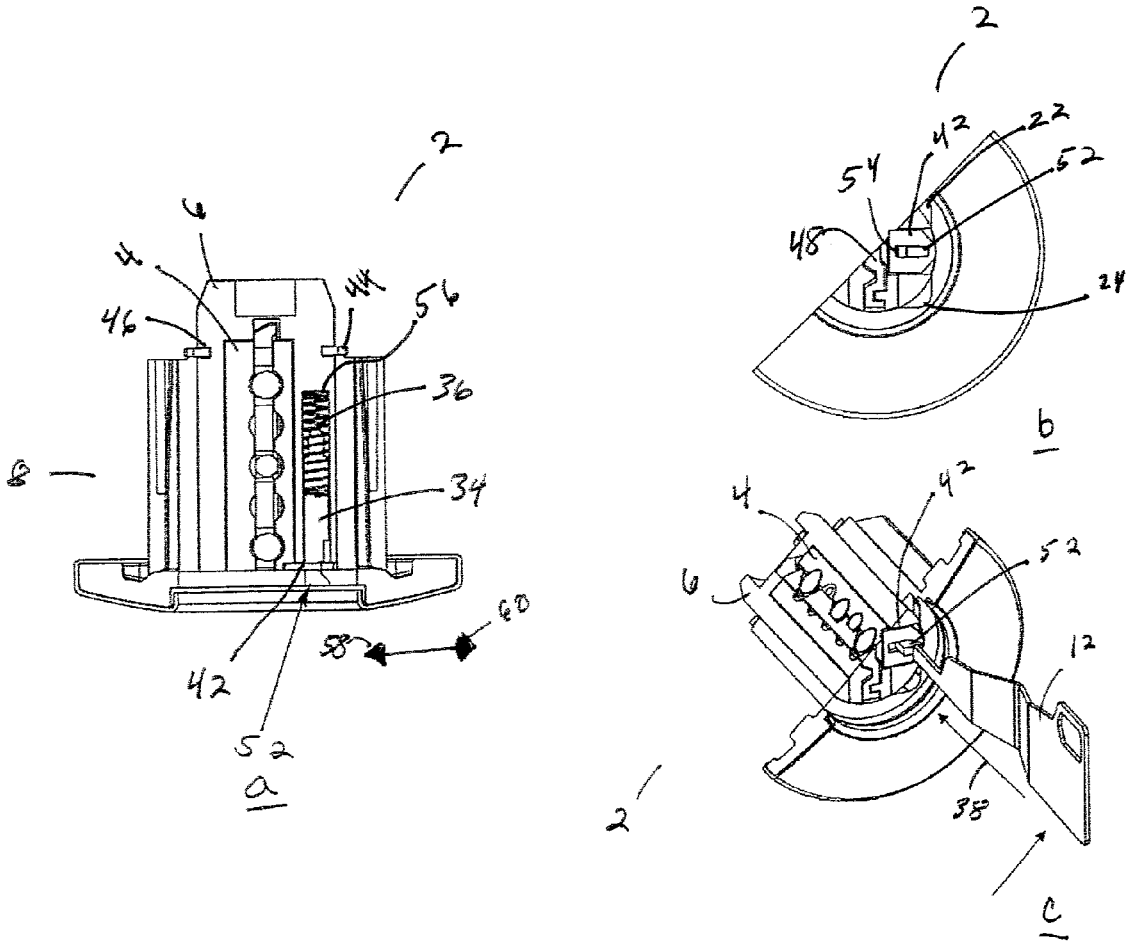
FIGS. 5*a-c* are top cross-sectional, front cutaway, and perspective cutaway views of the lock assembly.
Figure 6:
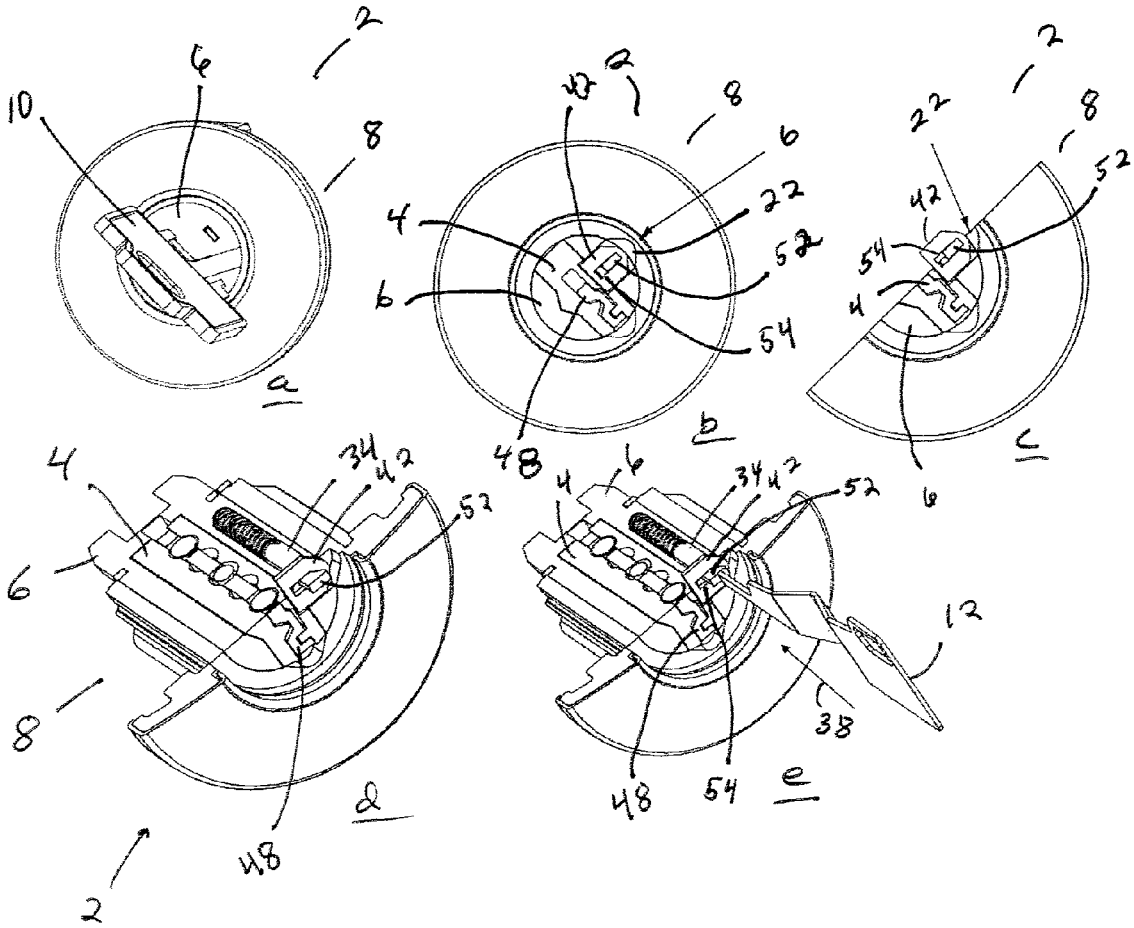
FIGS. 6*a-e* are front, front cutaway, and perspective cutaway views of the lock assembly.
Figure 7:
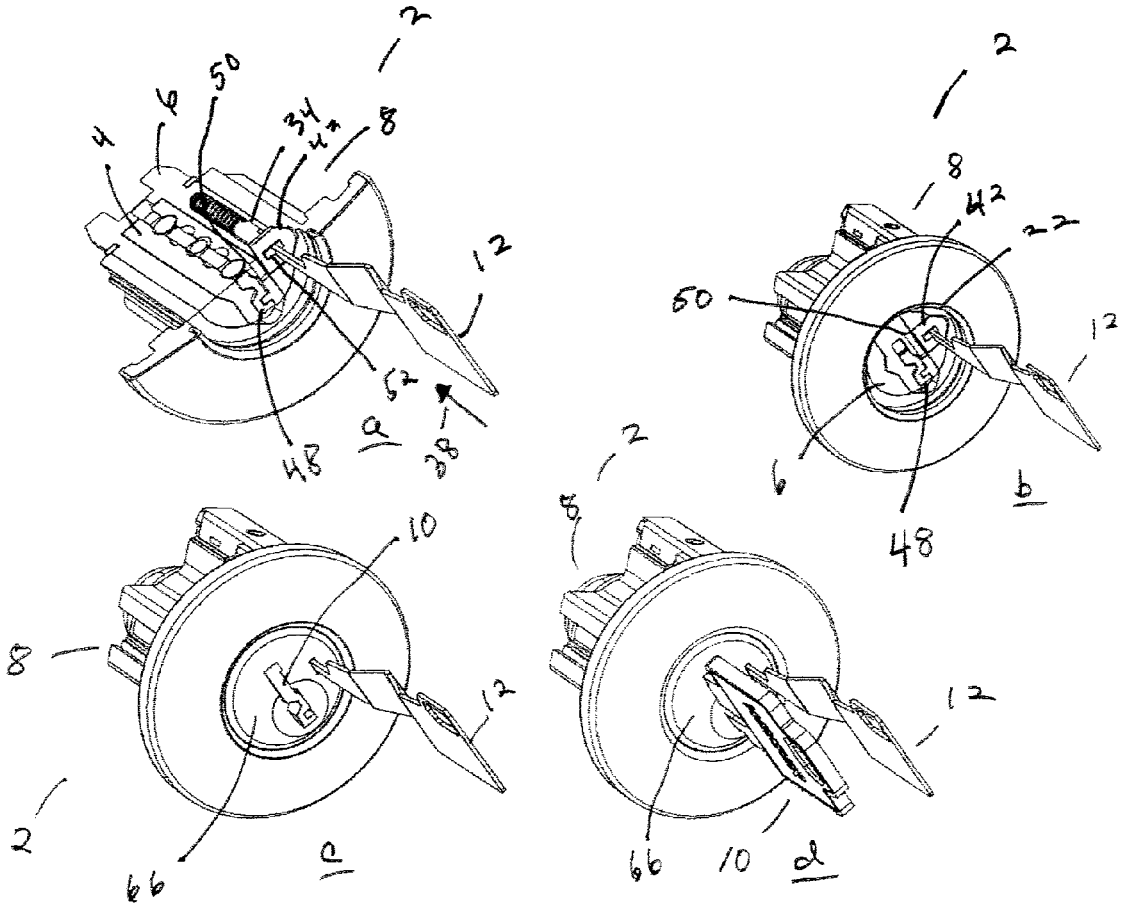
FIGS. 7*a-d* are perspective cutaway, and with various perspective views of the lock assembly.
Figure 8:
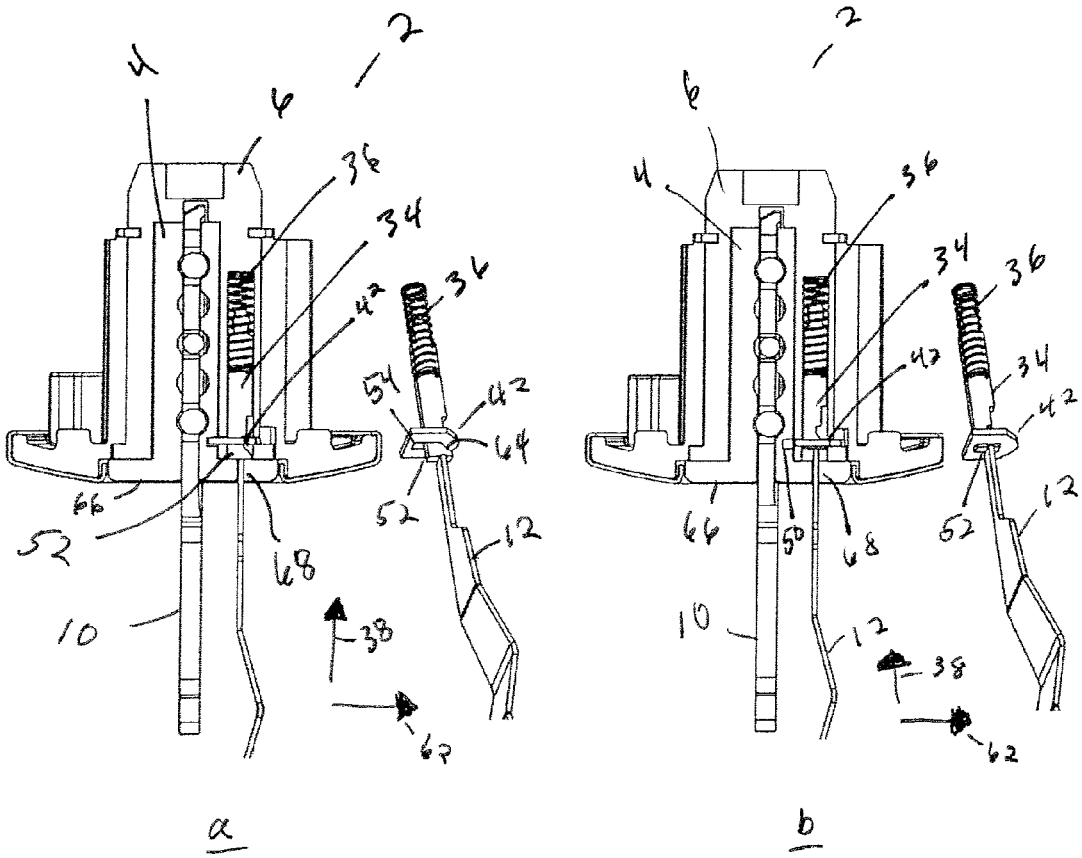
FIGS. 8*a* and *b* are top sectional views of the lock assembly.
Figure 9:
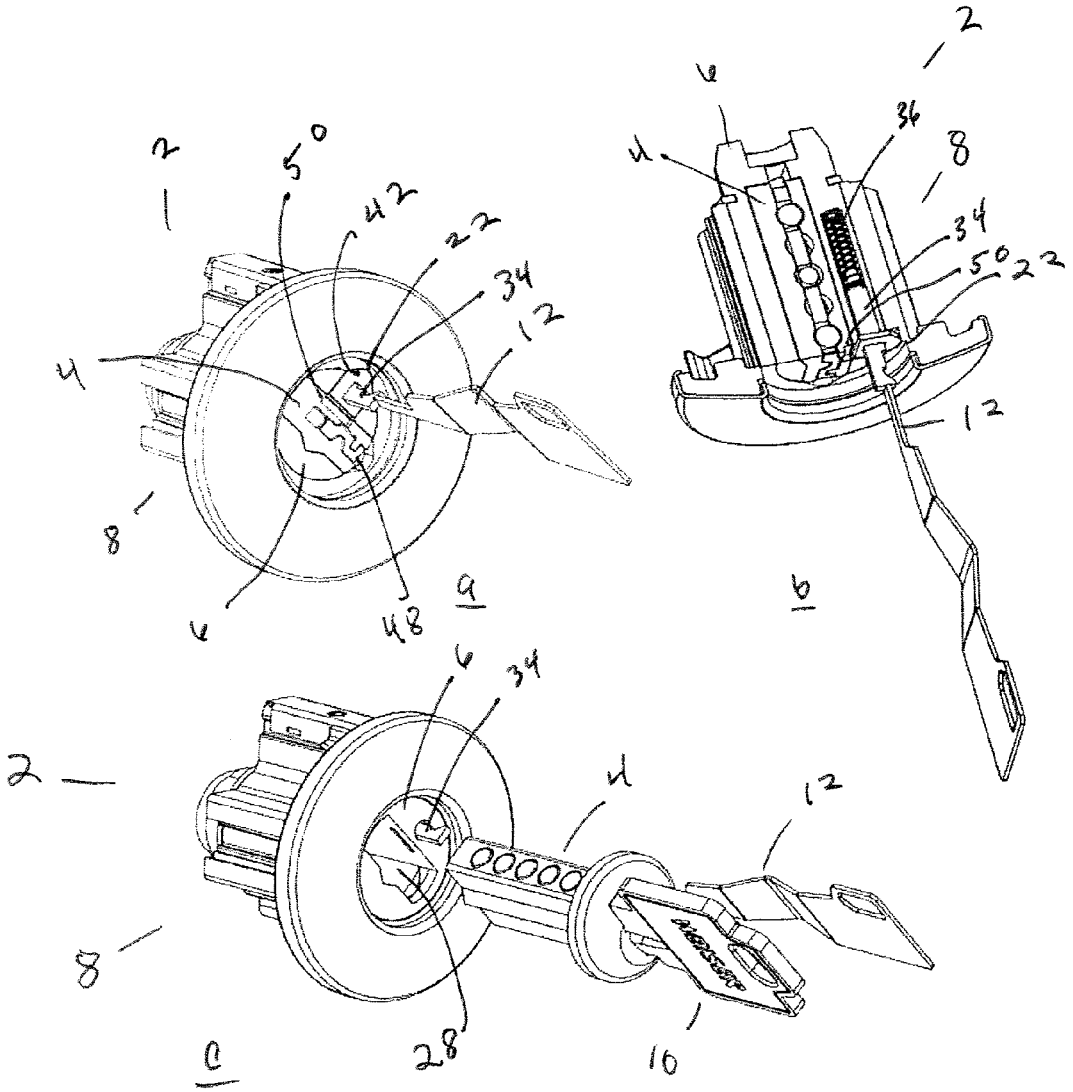
FIGS. 9*a-c* are various perspective and perspective cutaway views of the lock assembly.
Figure 10:
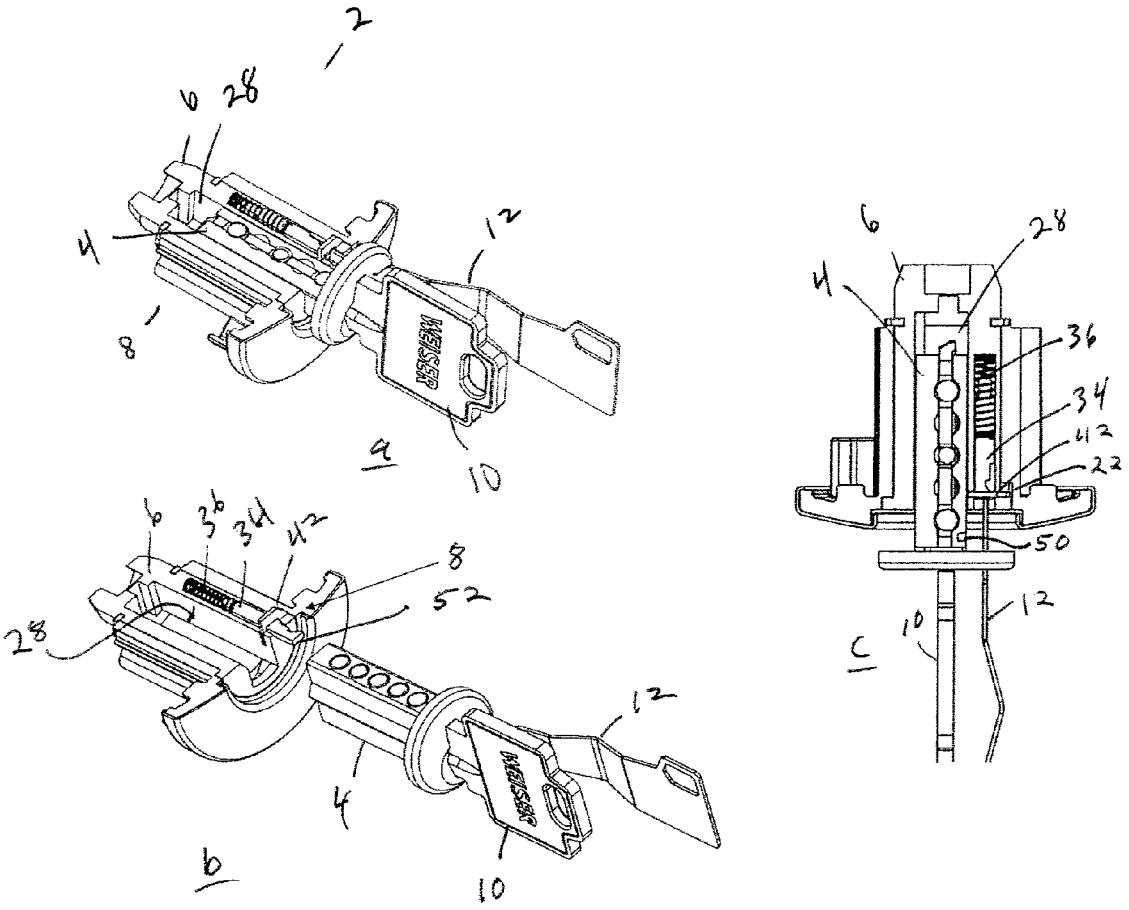
FIGS. 10*a-c* are various perspective cutaway and top cutaway views of the lock assembly.

A perspective exploded view of lock assembly 2 is shown in FIG. 3. This view includes cylinder 8 having a bore 20 disposed therethrough and configured to receive plug 6. At the periphery of bore 20 are pockets 22 and 24 which assist in the cassette removal process. Chimney 14 is also shown configured to receive top pins 16 and springs 17. A cap 26 attaches to chimney 14 covering top pin 16 and spring 17. Plug 6 includes a cassette slot 28 on its face and a longitudinally-extending opening 30 at top. Slot 28 is configured to receive cassette 4 and opening 30 allows communication between bottom pins 18 and top pins 16. Plug 6 also includes a tool hole 32 configured to receive plunger 34. Spring 36 engages plunger 34 to move the same longitudinally in directions 38 and 40. Plunger 34 also communicates with a locking tab 42 which is movable as plunger 34 moves. Clip retainer 44 is configured to engage slots 46 on plug 6 to keep the same held in bore 20 of cylinder 8.

The views in FIGS. 4-10 demonstrate how cassette 4 may be removed from plug 6. FIGS. 4*a-c* show the configuration of lock assembly 2 with key slot 48 in a vertical position (see, particularly, FIG. 4*a*). In this position, cassette 4 cannot be removed. The reason is that tab 42 is not positionable in either pockets 22 or 24 (see FIGS. 4*b* and *c*). As shown in FIG. 4*b*, pockets 22 and 24 are located at the periphery of bore 20 in cylinder 8. With key slot 48 in the vertical position, as shown in FIG. 4*c*, tab 42 fits into a recess 50 located in plug 4. Plunger 34 includes a head 52, which, as configured as illustratively shown, keeps tab 42 in the position shown. As depicted in FIG. 4*d*, when tab 42 is in this lock position, outside of either pockets 22 or 24, it blocks cassette 4 preventing it from being movable out of plug 6. This view also shows how cassette 4 fits into cassette slot 28 of plug 6. Also shown is head 52 of plunger 34 located in a slot 54 in tab 42 assisting to hold the same in place while key slot 48 is in the shown vertical position (again, see, also, FIG. 4*a*).

The views of FIG. 5*a-c* show further structures in lock assembly 2 while key slot 48 is in the vertical position. As shown in FIG. 5*a*, for example, plunger 34 is shown engaged with spring 36 in bore 56. Because head 52 of plunger 34 is located in slot 54 of locking tab 42, plunger 34 cannot move. There is no room for tab 34 to move. As shown, head 52 includes an angled surface which requires slot 54 and tab 42 to be moved in direction 60 in order to move plunger 34. But as previously discussed with respect to FIGS. 4*c* and *d*, tab 42 cannot move while in its current position. The view in FIG. 5*a* further demonstrates how tab 42 blocks cassette 4 preventing it from being removable from plug 6. This view also shows how clip retainer 44 engages slots 46 of plug 6 keeping the same in cylinder 8. The perspective front view in FIG. 5*b* further demonstrates how tab 42 is not moveable while key slot 48 is vertical and locking tab 42 is not located in either pockets 22 or 24. Similarly, the view in FIG. 5*c* demonstrates how even engaging head 52 of plunger 34 with resetting tool 12 will not move tab 42. Again, this keeps cassette 4 in plug 6.

FIGS. 6*a-e* demonstrate how the structures of lock assembly 2 react when key 10 is rotated to about 45 degrees (see in particular FIG. 6*a*). As shown in FIG. 6*b*, key slot 48 is now positioned at about 45 degrees from its original vertical position (see FIG. 4*a*) so locking tab 42 is now able to fit into pocket 22 at the periphery of bore 20 of cylinder 8. Pocket 22 (or pocket 24 for that matter) provides additional space within which locking tab 42 can move. As shown in FIGS. 6*c* and 6*d*, tab 42 has an available direction of travel 62, although it has not moved there yet. But once plug 6 is located at the 45 degree angle, resetting tool 12 may be used to push against head 52 of plunger 34 in direction 38.

The views shown in FIGS. 7*a-d* depict what happens when resetting tool 12 pushes and moves plunger 34. As shown in FIG. 7*a*, for example, pushing resetting tool 12 in direction 38 pushes plunger 34 in direction 38 as well. It is appreciated that head 52 includes an angled edge 64 which serves to slide tab 42 in direction 62 (see also FIG. 8*a*.). By doing this, as shown in FIG. 7*b*, tab 42 moves at least partially in pocket 22 removing it from recess 50, which, again, is part of cassette 4. The view in FIG. 7*d* shows how this occurs when key 10 is also inserted into lock assembly 2. It is appreciated that cassette 4 may include a plug cover 66 so plunger 34 and other previously described structures are inaccessible exterior of lock assembly 2.

The top cross-sectional views in FIGS. 8*a* and *b* demonstrate how resetting tool 12 moves in direction 38 to move plunger 34 in direction 38 as well which moves tab 42 in direction 62. In this view, resetting tool 12 inserts into slot 68 in plug cover 66 to access head 52 of plunger 34. In the isolated view of FIG. 8*a*, the engagement between resetting tool 12 and head 52 is better illustrated. By moving resetting tool 12 in direction 38, angled surface 64 of head 52 slides tab 42 in direction 62 where there is sufficient space in slot 54 to allow tab 42 to move. Continued movement of resetting tool 12 and plunger 34 continues sliding tab 42 in direction 62 to remove the same from recess 50 of cassette 4. As this view and the isolated view of plunger 34, tab 42, and resetting tool 12 also illustrate, head 52 fits into slot 54 which means tab 42 has been removed from recess 50. The isolated view also demonstrates how resetting tool 12 will not push plunger 34 past tab 42. As shown, head 52 is oriented horizontally with respect to the orientation of resetting tool 12 so that resetting tool 12 cannot move any further past the front face of tab 42.

The view shown in FIGS. 9*a-c* depicts how cassette 4 may be removed from plug 6. As FIG. 9*a* demonstrates, because plunger 34 is spring loaded it will begin exiting as well. But as plunger 34 moves, it is configured to block blocking tab 42 preventing the same from sliding back into recess 50 in cassette 4. The view in FIG. 9*c* shows the same process at a perspective cutaway angle. It is also appreciated that being temporarily locked in this 45 degree angle, plug 6 is blocking top pins 16 preventing them from dropping out of chimney 14. Cassette 4 may then be removed from plug 6, as shown in FIG. 9*c*, without any worry of top pins 16 falling out as well.

FIGS. 10*a-c* depict cassette 4 being removed from plug 6. As shown in FIG. 10*a*, cassette 4 may be removed from slot 28 in plug 6. The same can be seen from the alternate top cross-sectional view of FIG. 10*c*. This view also shows how resetting tool 12 may be configured so cassette 4 may be removed while resetting tool 12 is still engaged with plunger 34. Lastly, FIG. 10*b* shows cassette 4 completely removed from slot 28 of plug 6. This view demonstrates how tab 42 stays out of slot 28 by virtue of plunger 34 so cassette 4 may be reinserted into slot 28 once it has been rekeyed.

Figure 11:
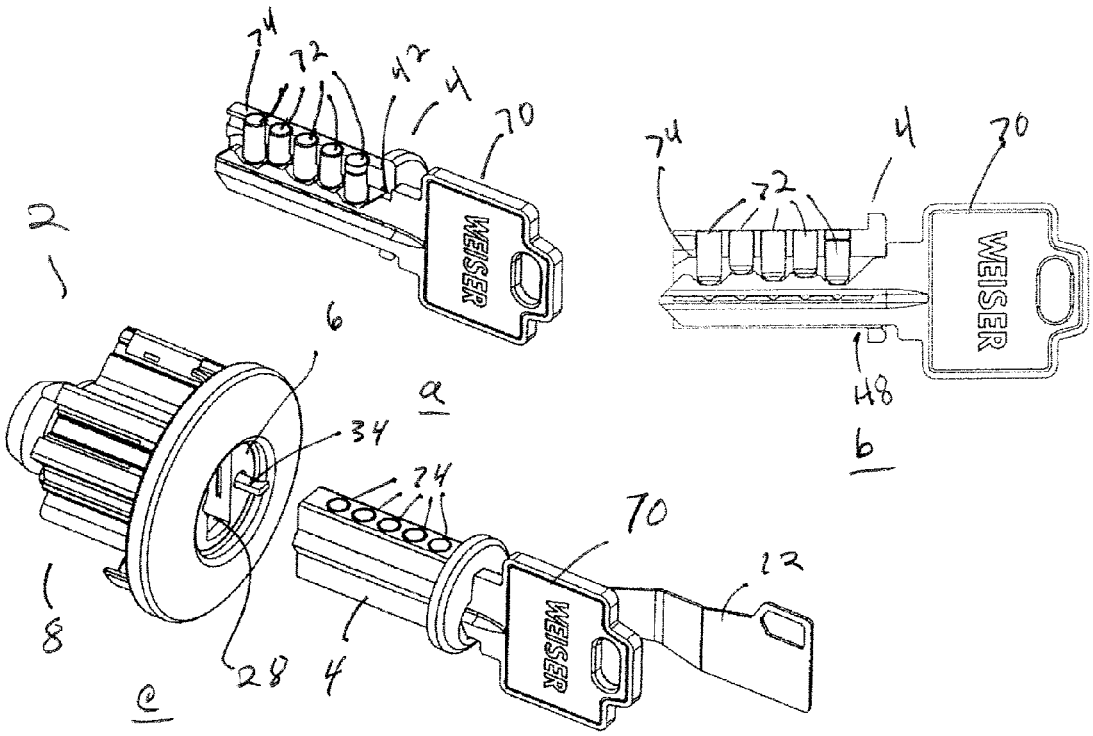
FIGS. 11*a-c* are perspective views of the lock assembly, perspective cross-sectional view of the key in the cassette, and side view of the key in the cassette.

The views shown in FIGS. 11*a-c* depict how cassette 4 may be rekeyed and then reinserted into plug 6. For example, the cross-sectional perspective view of FIG. 11*a* shows a new key 70 in key slot 48. New bottom pins 72 replace the original bottom pins 18 by removing them from openings 74 at the top of cassette 4. A side view of this is shown in FIG. 11*b*. Once cassette 4 is rekeyed with new bottom pin, 72, cassette 4 may be reinserted into slot 28 of plug 6. Rotating plug 6 45 degrees in the opposite direction and removing rekeying tool 12 will cause the bottom and top pins to reengage and tab 42 to slide back into recess 50 thereby locking cassette 4 in plug 6 again.

Additional features and advantages of the removable key plug assembly will become apparent to those skilled in the art upon consideration of the following detailed descriptions exemplifying the best mode of carrying out the removable key plug assembly as presently perceived. What is claimed is a removable key plug assembly.

What is claimed is:

1. A lock assembly comprising:

a lock cylinder having a bore disposed therein and at least one pocket located adjacent the periphery of the bore;

wherein the cylinder includes a chimney that houses top pins and corresponding springs;

a plug including a cassette slot, top opening, and a plunger bore;

wherein the plug is held in the lock cylinder by a retaining clip;

a plunger that fits in the plunger bore of the plug;

a locking tab having a slot disposed therein;

wherein the slot of the locking tab receives a portion of the plunger;

a cassette that has a key slot configured to receive a key, and openings configured to receive a plurality of pins that when the key is inserted into the key slot, the pins do not extend beyond a shear line located between the periphery of the lock cylinder bore and its chimney;

wherein the cassette includes a tool slot configured to receive a tool for engaging the plunger to selectively move at least a portion of the locking tab to the pocket;

wherein when the at least the portion of the locking tab is located in the pocket the locking tab does not block the cassette from being removed from the bore in the lock cylinder; and wherein the cassette is available to be rekeyed.

2. The lock assembly of claim 1, further comprising a spring that biases the plunger.

3. The lock assembly of claim 1, wherein rotating the plug with respect to the lock cylinder prevents the top pins from exiting the chimney when the cassette is removed from the plug.

4. A lock assembly comprising:

a lock cylinder having a bore disposed therein and at least one pocket located adjacent the periphery of the bore;

a plug including a cassette slot;

a plunger that fits in the plug;

a locking tab having a slot disposed therein;

wherein the slot of the locking tab receives a portion of the plunger;

a cassette having a key slot configured to receive a key;

wherein the cassette includes a tool slot configured to receive a tool to selectively engage the plunger to selectively move the locking tab into and out of the pocket; and wherein when a portion of the locking tab is located in the pocket the locking tab does not block the cassette from being removed from the plug.

5. The lock assembly of claim 1, further comprising a spring that biases the plunger.

6. The lock assembly of claim 1, wherein rotating the plug with respect to the lock cylinder prevents the top pins from exiting the lock cylinder when the cassette is removed from the plug.

7. A method for rekeying a lock cylinder comprising the steps of:

providing a lock cylinder that receives a plug, and wherein the plug receives a cassette;

inserting a key into a key slot in the cassette;

rotating the cassette and plug with respect to the lock cylinder;

inserting a tool through a tool slot located in the cassette and engaging a plunger located in the plug exterior of the cassette to move a locking tab;

moving the locking tab having a slot that receives the plunger to cease the tab from being a barrier that prevents the cassette from being removed from the plug; and removing the cassette from the plug.

* * * * *